US007490424B2

(12) United States Patent
Caterinacci

(10) Patent No.: US 7,490,424 B2
(45) Date of Patent: Feb. 17, 2009

(54) TELESCOPIC SIGN HOLDER

(75) Inventor: John Caterinacci, Hudson, OH (US)

(73) Assignee: Fasteners for Retail, Inc.

( * ) Notice: Subject to any disclaimer, the term of this patent is extended or adjusted under 35 U.S.C. 154(b) by 235 days.

(21) Appl. No.: 11/020,902

(22) Filed: Dec. 22, 2004

(65) Prior Publication Data

US 2006/0130381 A1 Jun. 22, 2006

(51) Int. Cl.
*G09F 7/18* (2006.01)
*G09F 7/00* (2006.01)

(52) U.S. Cl. ..... 40/606.14; 40/611.07

(58) Field of Classification Search ..... 40/606.01, 40/606.14, 607.04, 607.09, 611.01, 611.07, 40/653, 654, 607.08; 211/105.1, 105.2, 105.3; 248/298.1, 473, 297.31, 297.21, 476, 488, 248/490

See application file for complete search history.

(56) References Cited

U.S. PATENT DOCUMENTS

| | | | | | |
|---|---|---|---|---|---|
| 849,855 | A | * | 4/1907 | Repp | 211/105.3 |
| 1,025,349 | A | * | 5/1912 | Weisberger | 211/85.26 |
| 1,102,001 | A | * | 6/1914 | Cobourn | 40/606.18 |
| 3,236,481 | A | * | 2/1966 | Howard | 40/607.04 |
| 3,954,182 | A | * | 5/1976 | McEvers | 211/94.01 |
| 4,557,064 | A | | 12/1985 | Thompson | |
| 4,771,899 | A | * | 9/1988 | Benedict et al. | 211/60.1 |
| 5,014,954 | A | * | 5/1991 | Merl | 248/285.1 |
| 5,660,286 | A | * | 8/1997 | Shea | 211/87.01 |
| 5,664,749 | A | | 9/1997 | Kump et al. | |
| 5,678,794 | A | | 10/1997 | Kump | |
| 6,024,230 | A | * | 2/2000 | Menaged et al. | 211/87.01 |
| 6,412,202 | B1 | | 7/2002 | Oswood | |
| 6,446,819 | B1 | | 9/2002 | Mattesky | |
| 6,612,057 | B2 | | 9/2003 | Shoemaker et al. | |
| 6,698,124 | B2 | | 3/2004 | Kump et al. | |
| 2002/0153337 | A1 | * | 10/2002 | Shuen | 211/123 |

* cited by examiner

*Primary Examiner*—Robert J Sandy
*Assistant Examiner*—Ruth C. Rodriguez
(74) *Attorney, Agent, or Firm*—Fay Sharpe LLP

(57) ABSTRACT

A telescopic sign holder for mounting to a support surface comprises a first elongated member and a second elongated member including a longitudinal axis. The second elongated member is slidably mounted in relation to the first elongated member. An adjusting structure axially spaces the second elongated member relative to the first elongated member. The adjusting structure comprises a portion of at least one of the first and second elongated members. A support member is attached to the first elongated member and includes a mounting element which releasably secures the support member to the support surface. A display member is connected to the second elongated member for releasably holding a sign. The display member includes a longitudinal axis which extends parallel to the longitudinal axis of the second elongated member.

25 Claims, 9 Drawing Sheets

TELESCOPIC SIGN HOLDER

BACKGROUND OF THE INVENTION

The invention relates generally to sign holders. More particularly, the present invention relates to a point of purchase telescopic sign holder which provides information concerning a package or item located adjacent the sign holder.

Shelving structures and related display units for displaying merchandise are a common sight in any type of store or commercial establishment. The desire of any merchant is and always has been to draw a shopper's attention to the items the merchant is offering for sale.

Vertically extending pegboard surfaces are particularly effective for displaying small, high volume merchandise on hooks and other horizontally extending fasteners. Such pegboard display systems have long been popular with retail merchants. The pegboard support has a matrix of uniformly spaced holes that can receive product support devices such as display hooks or brackets. These display hooks have a mounting base including one or more hook shaped prongs which extend rearwardly of the mounting base and engage selected mounting holes in the matrix of holes formed in the pegboard support. When mounted at desired positions on the display surface, the display hooks project forwardly thereof to hold merchandise.

Of course, there are also a wide variety of known shelving displays as well. The merchandise displayed in each of these ways needs to have its price identified. This is generally done by sign holders. Sign holders can also be employed to indicate that a particular item is on sale, as well as for other purposes. A variety of differing sign holders and methods of attachment of those sign holders to support structures located adjacent the merchandise are known.

In a first type, a separate display hook and sign holder are mounted to a pegboard. The display hook has a mounting base and a support arm connected to the mounting base and extending forwardly of the front surface of the support panel. The sign holder has a mounting base, a display arm and an information display plate. The mounting base can be a plate which is thin enough to permit it to be interposed between the pegboard and the base of the display hook. The plate is also provided with engagement means for engaging the prongs of the display hook to prevent the sign holder from sliding down in relation to the display hook.

In another design, the sign holder has a mounting base with a prong which can be secured in an aperture of the support panel adjacent the location of the display hook. However, with different lengths of display hooks, different lengths of such conventional sign holders are also necessary. Generally, the display hooks can range from 10 to 14 inches. Therefore, a variety of sign holder lengths is necessary, one for each length of display hook. This is disadvantageous from the standpoint of the merchant who needs to replace the sign holder used every time a different length display hook is employed.

Another display hook and information display panel system includes a unitary arrangement in which the sign holder is of one piece with the display hook such that both elements are manufactured as a single plastic piece. Obviously with a unitary arrangement, there is no problem in matching the length of the sign holder to the length of the display hook.

An adjustable length sign holder is also known. This sign holder generally includes a plastic mounting base having a through socket in which a metal display arm may slide to adjust the length of the sign holder. However, this type of information display bracket demands that there be room behind the pegboard to accommodate whatever length of display arm extends through the pegboard. In addition, with this sign holder, there is no means provided to securely lock the display arm in the mounting base to prevent a sliding movement thereof.

Also known is an adjustable length guard assembly for a pegboard hook wherein the flexible guard is adapted to overlie the arm of the hook and a shield of the guard substantially encloses the outer end of the hook. The guard is formed by two slidable telescoping sections. The effective length of the guard can be changed to enable the guard to be used with hanger arms of different lengths. However, the known types of adjustable sign holders do not display a sign in a "flag" fashion, i.e., with the sign extending along, or in a plane approximately parallel to, a longitudinal axis of the sign holder.

Accordingly, it has been considered desirable to develop a new and improved adjustable length sign holder which would overcome the foregoing difficulties and others while providing better and more advantageous overall results.

BRIEF DESCRIPTION OF THE INVENTION

In an exemplary embodiment of the invention, a telescopic sign holder is provided.

More particularly, in accordance with this aspect of the present invention, the telescopic sign holder for mounting to a support surface comprises a first elongated member and a second elongated member including a longitudinal axis. The second elongated member is slidably mounted in relation to the first elongated member. An adjusting structure axially spaces the second elongated member relative to the first elongated member. The adjusting structure comprises a portion of at least one of the first and second elongated members. A support member is attached to the first elongated member and includes a mounting element which releasably secures the support member to the support surface. A display member is connected to the second elongated member for releasably holding a sign. The display member includes a longitudinal axis which extends parallel to the longitudinal axis of the second elongated member.

In accordance with another aspect of the present invention, the telescopic sign holder, which is mounted to a generally vertically oriented support surface, comprises a first elongated member and a second elongated member. The first elongated member includes a base section and a pair of generally parallel arm sections extending therefrom. The base section and the arm sections define a first generally U-shaped channel. The second elongated member is slidably secured to the first elongated member. The second elongated member includes a base section and a pair of generally parallel arm sections extending therefrom. The base section and the arm sections define a second generally U-shaped channel. A support member is attached to the first elongated member and includes a generally planar section and at least one engaging finger extending from the planar section for securing the support member to the support surface. A display member is secured ton the second generally U-shaped channel and selectively holds a sign.

In accordance with still another aspect of the present invention, a telescopic sign holder for mounting to an approximately vertically oriented support surface comprises a first elongated member and a second elongated member. The second elongated member is telescopically received by the first elongated member and a portion of the second elongated member projects from the first elongated member. A support member is attached to the first elongated member. The support member includes a planar portion and a finger protruding therefrom. The finger engages an aperture in the support surface. A display member is secured to the second elongated member. The display member includes an engagement portion, for engaging the second elongated member, a hinge portion connected to the engagement portion and a sign holding portion connected to the hinge portion for selectively holding a sign in a pivotable manner.

Still other aspects of the invention will become apparent from a reading and understanding of the detailed description of the preferred embodiments hereinbelow.

BRIEF DESCRIPTION OF THE DRAWINGS

The present invention may take physical form in certain parts and arrangements of parts, preferred embodiments of which will be described in detail in this specification and illustrated in the accompanying drawings which form a part of the invention.

DETAILED DESCRIPTION OF THE PREFERRED EMBODIMENTS

Figure 1:
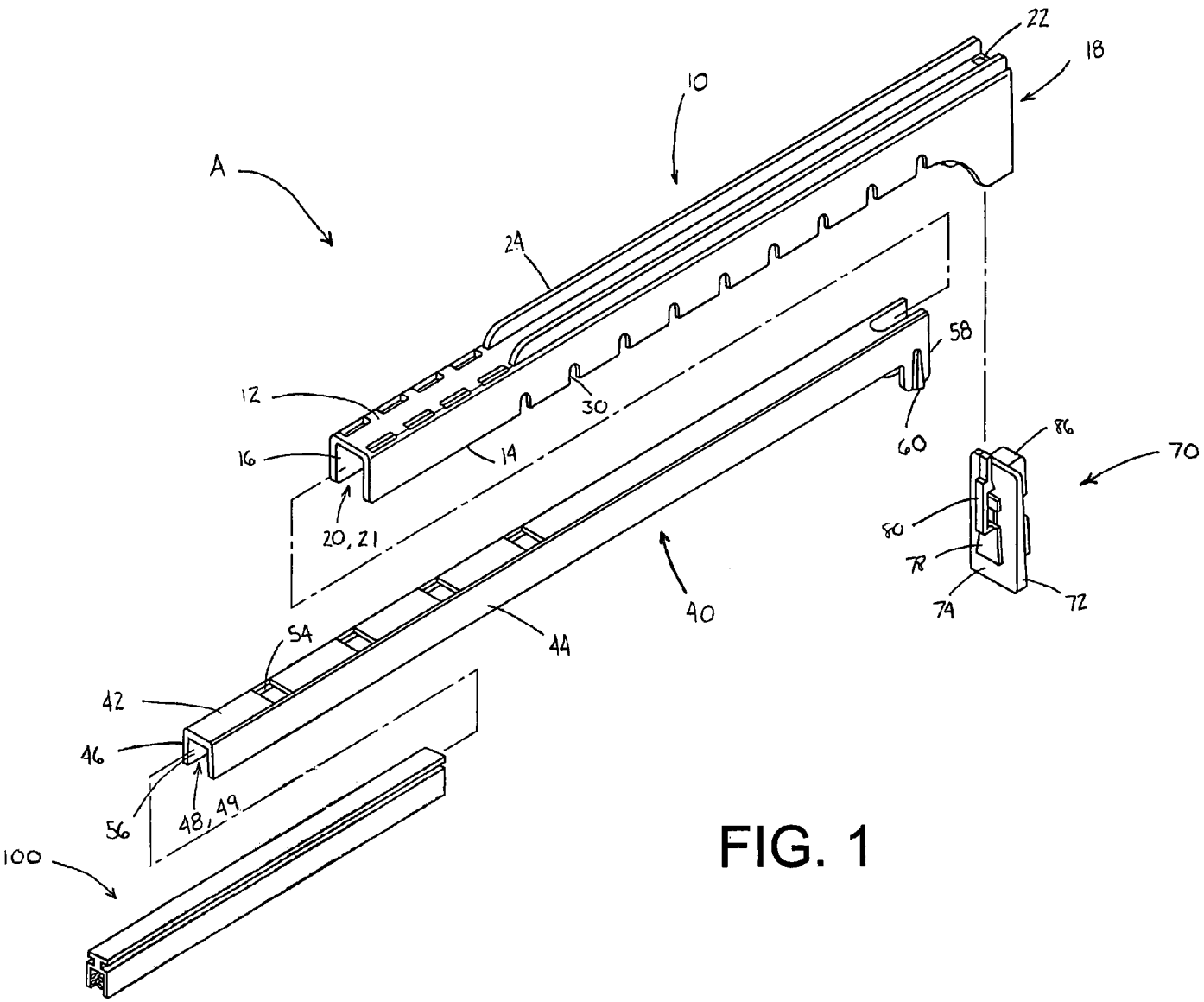
FIG. 1 is an exploded perspective view of a sign holder according to a first preferred embodiment of the present invention.
Figure 2:
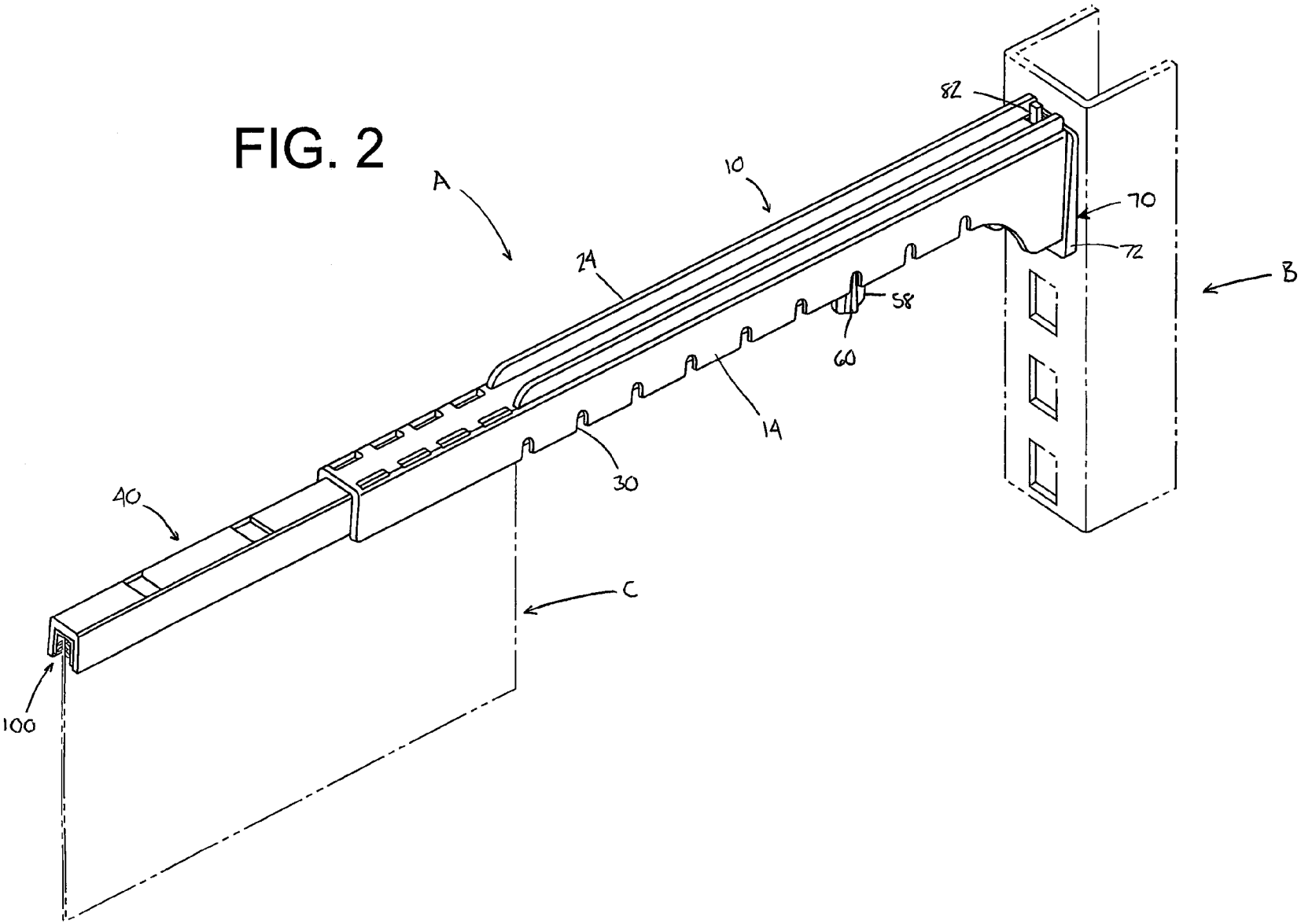
FIG. 2 is a perspective view of the telescopic sign holder of FIG. 1 in an assembled form, mounted to a support and holding a sign.

Referring now to the drawings, wherein the showings illustrate the preferred embodiments of the invention only and are not intended to limit same, FIGS. 1 and 2 show a telescopic sign holder A for mounting to a support surface B in accordance with a first embodiment of the present invention. While the telescopic sign holder A is primarily designed for, and will hereinafter be described in connection with a particular type of support surface B, it should be appreciated by those of average skill in the art that the sign holder could also be utilized in other types of display environments wherein other types of support surfaces are provided. These can include freezer cases, wire baskets, wire shelving, warehouse-type shelving and the like.

The telescopic sign holder A includes a first elongated member 10, a second elongated member 40, a support member 70 and a display member 100 for releasably securing a sign C. The sign may be a sheet of plastic, card, paper, or the like. In this embodiment, and as will be described in more detail below, the display member 100 is connected to the second elongated member 40 which is slidably mounted in the first elongated member 10.

Figure 6B:
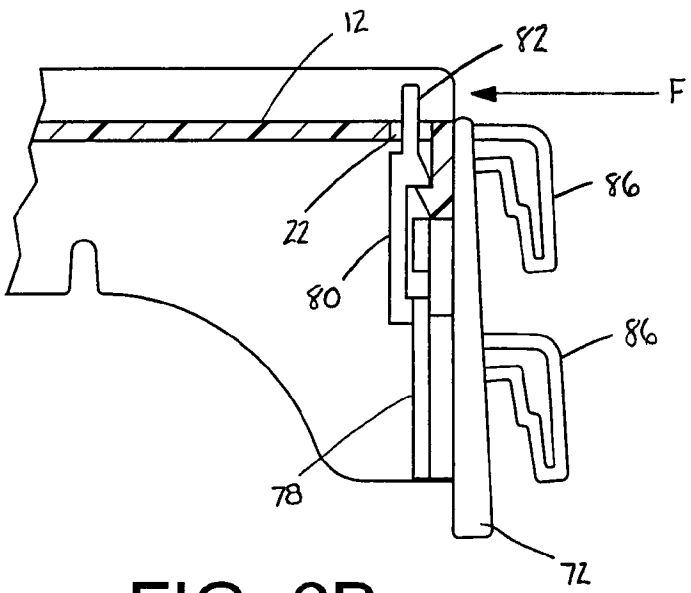
FIG. 6B is a side elevational view, partially broken away, of the first elongated member and the support member of FIG. 6A in assembled form.
Figure 6A:
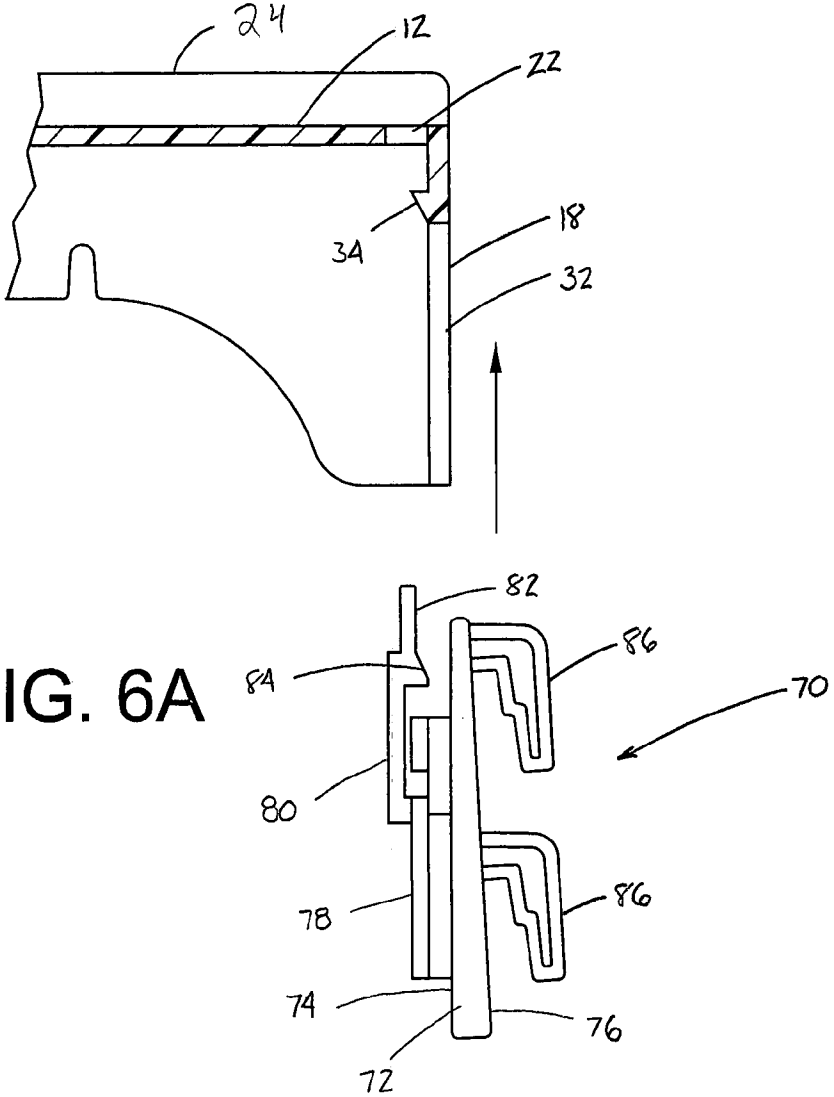
FIG. 6A is an exploded side elevational view, partially broken away, of a portion of a first elongated member and the support member of the telescopic sign holder of FIG. 1 illustrating how they cooperate.

With continued reference to FIGS. 1 and 2, the first elongated member 10 includes a base section 12, a pair of generally parallel arm sections 14, 16 extending therefrom and an end wall 18. The base section and the arm sections define a first generally U-shaped channel 20. The U-shaped channel has an open end 21 opposite the base section 12 for telescopically receiving the second elongated member 40. As best shown in FIG. 6A, the base section includes an aperture 22 which receives a portion of the support member 70. The base section 12 further includes at least one reinforcing member 24, in this embodiment in the form of a rib or ridge. It should be appreciated that the reinforcing member could take other forms. It provides the sign holder A with additional stability against deflecting forces. In this embodiment, two such reinforcing members are provided.

Figure 4B:
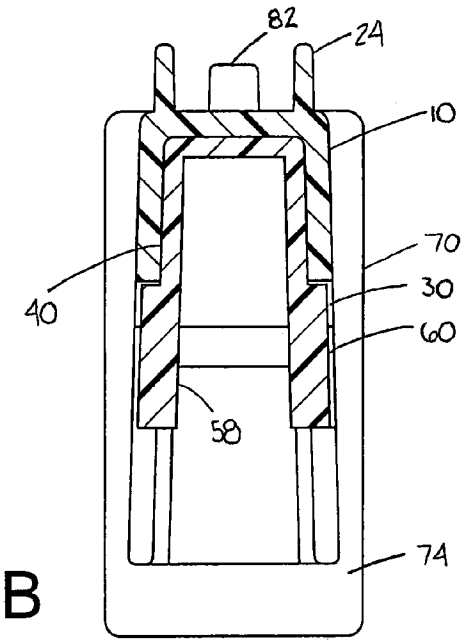
FIG. 4B is a cross-sectional view of the telescopic sign holder of FIG. 3, taken generally along the line 4B-4B.
Figure 4A:
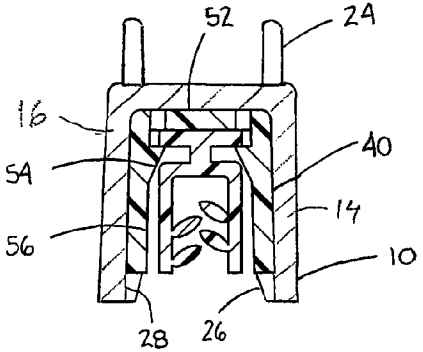
FIG. 4A is a cross-sectional view of the telescopic sign holder of FIG. 3, taken generally along the line 4A-4A.

With reference now to FIG. 4A, each arm section 14, 16 includes at least one tab 26 extending inwardly from an inner surface 28 of the arm section. The tab holds a cooperating bottom portion of the second elongated member 40 within the first U-shaped channel 20. The tab can have a generally triangular cross-section in the form of a right triangle with a first side contiguous with the inner surface of the arm section and a second side extending approximately normal to the first side. However, it should be appreciated by one skilled in the art that the tab 26 can have other cross-sections, such as a rectangular cross-section. In the present invention, the arm sections 14, 16 can include four spaced apart tabs which essentially define an inner shelf. Of course, more or less than four tabs could be employed for slidably supporting the second elongated member 40.

Figure 3:
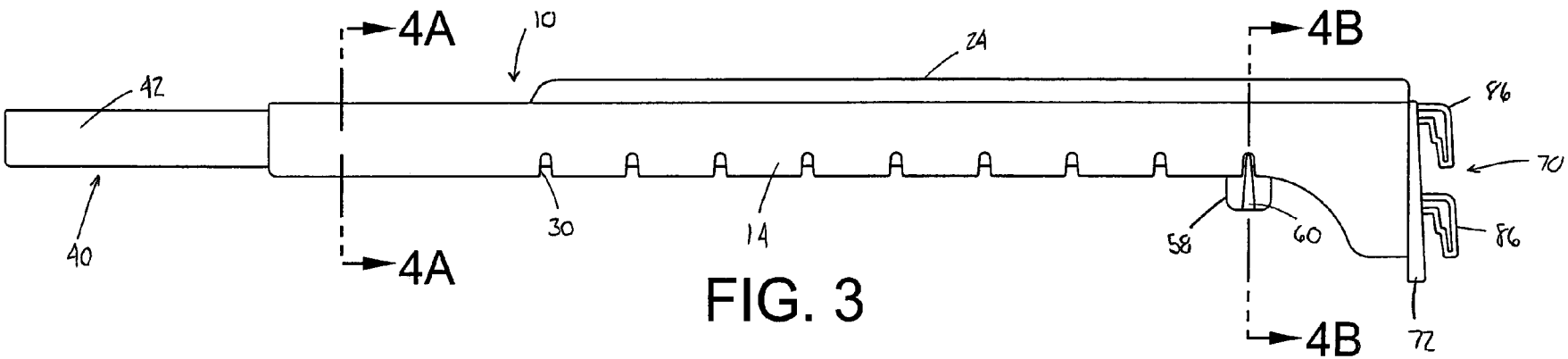
FIG. 3 is a side elevational view of the telescopic sign holder of FIG. 1 in an assembled form.
Figure 8A:
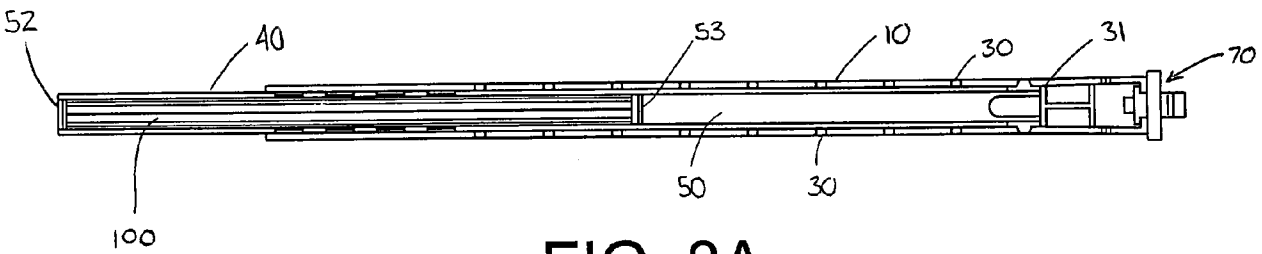
FIGS. 8A and 8B are bottom plan views of the sign holder of FIG. 3 showing the second elongated member in two telescopic positions in relation to the first elongated member.
Figure 8B:
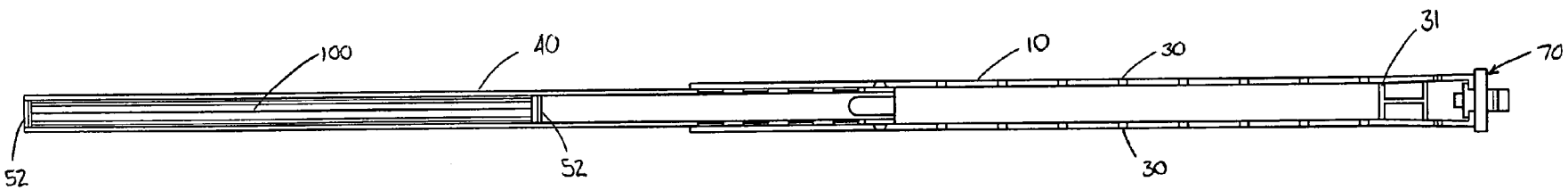

With reference to FIGS. 2 and 3, each arm section 14, 16 of the first elongated member 10 includes a plurality of adjustment notches 30 disposed along a bottom portion of the arm sections. As will be discussed in greater detail below, the notches allow for the selective movement of the second elongated member 40 within the first U-shaped channel 20 of the first elongated member 10. As shown in FIGS. 8A and 8B, the first elongated member 10 also includes a downwardly extending stop wall 31 adjacent one of the adjustment notches 30 for preventing any further rearward axial movement of the second elongated member within the first U-shaped channel.

With reference to FIG. 6A, the end wall 18 includes an elongated slot 32 and an axially extending tab 34. The elongated slot is dimensioned to receive a portion of the support member 70 while the tab releasably secures the support member in place.

Referring back to FIGS. 1 and 2, the second elongated member 40 includes a base section 42 and a pair of generally parallel spaced arm sections 44, 46 extending therefrom. The base section and the arm sections define a second generally U-shaped channel 48 having an open end 49 opposite the base section 42. The second U-shaped channel is dimensioned to receive the display member 100 along a longitudinal axis of the second elongated member. As shown in FIG. 8A, an inner surface 50 of the base section 42 includes a pair of spaced apart transverse walls 52 and 53 which prevent an axial movement of the display member 100 within the second U-shaped channel 48.

With reference again to FIG. 4A, at least one of the arm sections 44, 46 of the second elongated member 40 includes a flange 54 extending inwardly from an inner surface 56 of the arm section. The flange secures the display member 100 within the second U-shaped channel 48. In one embodiment, the arm sections 44, 46 can each include four spaced apart flanges. Of course, more or less than four flanges 54 could be employed for holding the display member 100.

As shown in FIG. 3, the second elongated member 40 further includes a resilient tab 58 which extends downwardly from an end portion of each arm section 44, 46. Each tab includes a protrusion 60. The protrusions are dimensioned to be received in the notches 30 of the first elongated member 10. As shown in FIG. 4B, the protrusions 60 can be selectively engaged with one of the notches 30 to secure the second elongated member at a desired location in relation to the first elongated member.

With reference to FIG. 6A, the support member 70, which can be attached to the first elongated member 10, includes a generally planar member 72 having a first surface 74 and a second surface 76. A generally T-shaped flange 78 extends from the first surface. A resilient finger 80 projects from an end of the T-shaped flange 78. As shown in FIG. 6B, a tip 82 of the finger protrudes through the aperture 22 in the base section 12 of the first elongated member 10. The finger also includes a tab 84 which engages the end wall tab 34 thereby further securing the support member 70 to the end wall 18. It should be also noted that the support member is somewhat wedge-shaped, such that the second surface 76 angles towards the first surface 74 from the bottom of the support member to its top. This form of the support member 70 enables it to hold the telescopic sign holder horizontally so that it does not droop.

The support member 70 further includes at least one projecting finger 86 extending from the second surface 76 of the planar member 72. The finger engages at least one aperture of the support surface B thereby mounting the sign holder A to the support surface. Specifically, in this embodiment, the support member 70 includes a pair of generally L-shaped engaging fingers 86 extending rearwardly and downwardly from the second surface 76 of the planar member 72 in a spaced relationship. These fit in spaced apertures in the vertical support member B illustrated in FIG. 2.

The support member 70 is capable of quickly and effectively mounting the sign holder A to the support surface B by inserting downwardly projecting ends of the pair of L-shaped fingers 86 into the apertures of the support surface B and then moving the support member 70 downwardly so that the L-shaped fingers fixedly engage the support surface. As shown in FIG. 2, the support member 70 is releasably mounted in place once the apertures of the support surface B are engaged by the pair of extending fingers 86 and the planar member 72 of the support member 70 is rotated so that it lies flush against the support surface.

Figure 5:
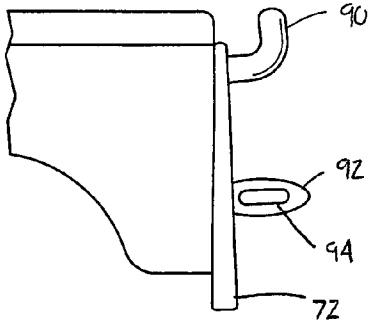
FIG. 5 is a side elevational view of an alternate embodiment of a support member which can be used with the sign holder of FIG. 1.

Other support members are also contemplated. For example, with reference to FIG. 5, the planar member 72 can include an upwardly extending finger 90 and a tab 92 having an elongated aperture 94 to give the tab flexibility. Such a construction would be useful to mount the sign holder to a pegboard or the like.

Figure 12B:
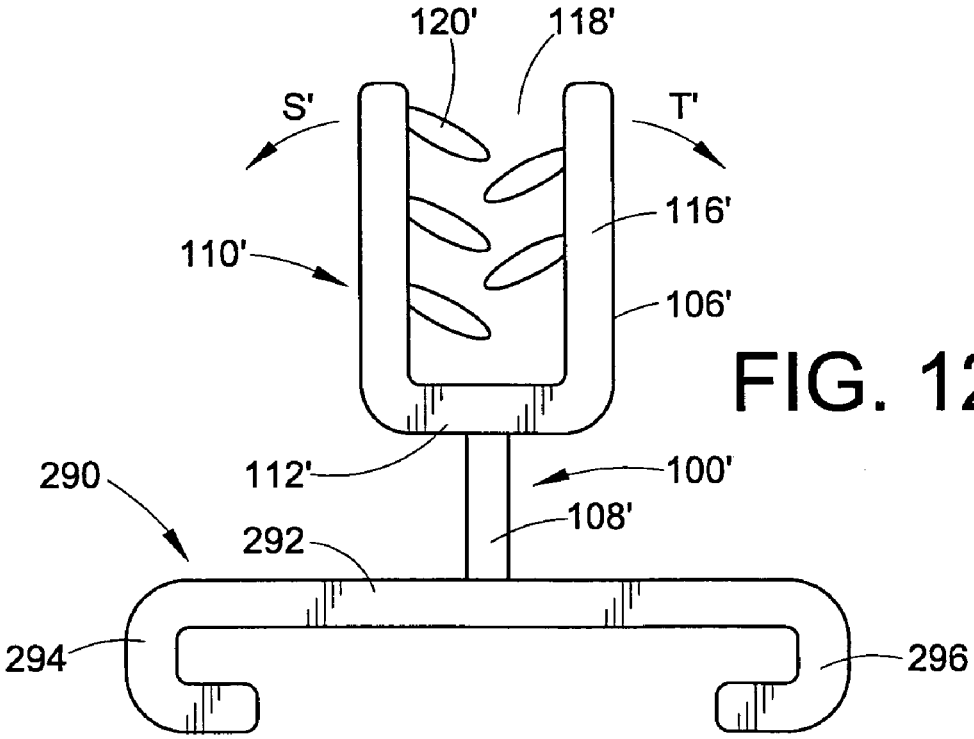
FIG. 12B is an enlarged front elevational view of a display member of the telescopic sign holder of FIG. 9.
Figure 12A:
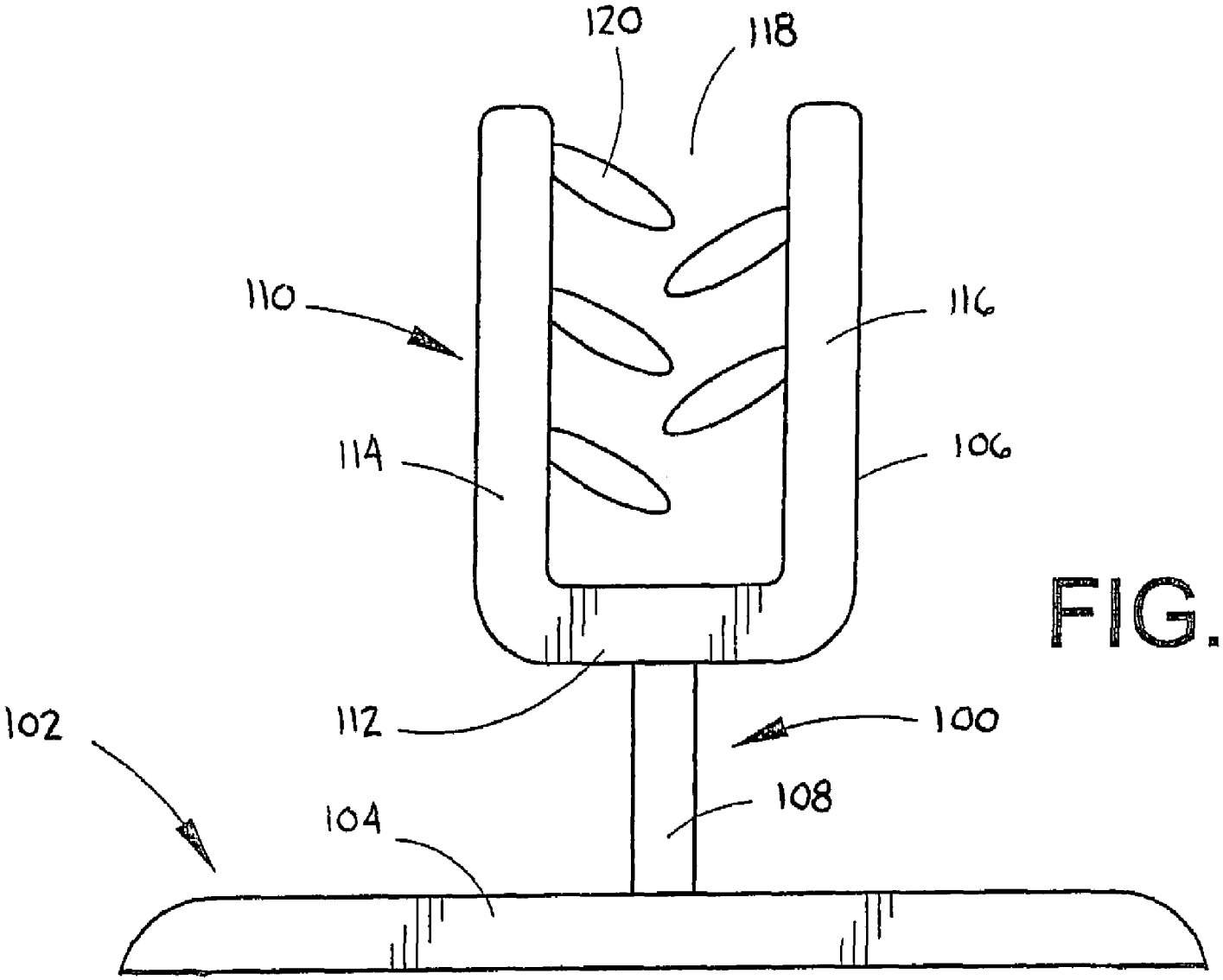
FIG. 12A is an enlarged front elevational view of a display member of the telescopic sign holder of FIG. 1.

With reference now to FIG. 12A, the display member 100 includes a proximal or engagement portion 102 which is shaped to releasably engage the second elongated member 40. Specifically, the engagement portion includes a generally planar base wall 104 which is received by the inwardly extending flanges 54 of the arm sections 44, 46 thereby securing the display member 100 within the second U-shaped channel 48.

The display member further includes a display or distal portion, such as a sign holding portion 106, for holding the sign C. The sign holding portion extends away from the base wall 104 and is connected thereto by a hinge 108. The hinge can be a living hinge which can comprise a strip of flexible material which connects the base wall 104 and the sign holding portion 106. The hinge 108 is resiliently flexible, allowing the sign holding portion to flex or pivot in use, relative to the engagement portion, when a force is applied, for example, when a shopper knocks the sign. This causes the hinge to flex. The material from which the hinge is made has a memory. Thus, once the applied force is removed, the hinge 108 flexes back and returns to its original position-generally perpendicular to the base wall 104.

The sign holding portion 106 of the display member 100 releasably and frictionally holds the sign C. The sign displays information about adjacent products on pegboard hooks or shelves, such as price or the fact that a product is on sale at a discounted price. The sign holding portion may comprise a U-shaped channel 110, connected to the hinge 108 by a central wall 112, thereof. Two side walls 114, 116 extend away from the central wall 112 to define the U-shaped channel 110 for receiving the sign. The U-shaped channel has an open end 118 opposite the central wall 112. Resiliently flexible fins 120 extend into the channel 110 from each of the side walls 114, 116 to frictionally engage opposite sides of the sign C. Preferably, the fins are oriented such that their distal tips point inwardly towards the central wall 112. As shown in FIG. 12A, the fins attached to one side wall are interdigitated with those on the other wall (the tips slightly overlapping), although other arrangements are also contemplated. The fins 120 flex upwardly to allow the sign to be inserted but resist removal of the sign by gripping it when an attempt is made to pull the sign downwardly.

To assemble the telescopic sign holder A, and with reference to FIG. 1, the display member 100 is first secured within the second U-shaped channel 48 of the second elongated member 40. Specifically, the forward wall 104 of the display member is positioned above the flanges 54 of the arm sections 44, 46. As such, the flanges extend toward the hinge 108 of the display member (FIG. 4A). The display member is then slid within the second U-shaped channel 48 along the longitudinal axis of the second elongated member 40 until it contacts one of the downwardly extending walls 52 of the base section 42 (FIG. 8A). The display member 100 will then be positioned between the walls 52, which prevent the axial movement of the display member, and secured within the second U-shaped channel 48.

Next, the second elongated member 40 is secured within the first U-shaped channel 20 of the first elongated member 10. Specifically, an inward force is applied to the resilient tabs 58 of the of arm sections 44, 46 of the second elongated member 40. This allows that portion of the second elongated member 40 to axially slide past the inwardly extending tabs 26 of the arm sections 14, 16 of the first elongated member 10. As the resilient tabs 58 move past the tabs 26, a cooperating bottom portion of the second elongated member 40 is held by the tabs 26 within the first U-shaped channel 20. As shown in FIGS. 8A and 8B, the protrusions 60 of the resilient tabs 58 are then selectively engaged with one of the notches 30 to secure the second elongated member 40 at a desired location in relation to the first elongated member 10.

Figure 7:
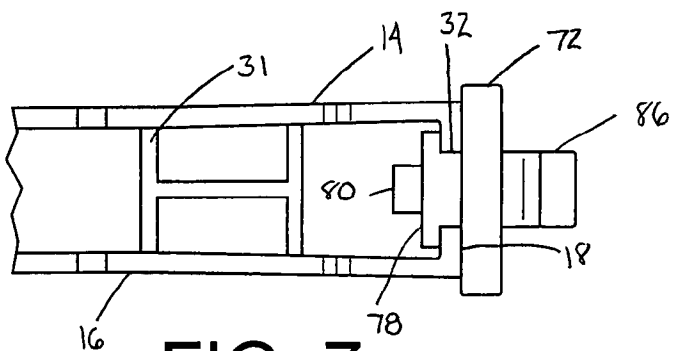
FIG. 7 is a bottom plan view of the first elongated member and the support member of FIG. 6B.

With reference now to FIG. 6A, the T-shaped flange 78 of the support member 70 is slidingly secured in the slot 32 of the end wall 18 of the first elongated member 10. Specifically, the support member is positioned below the end wall 18, and slid upward, the T-shaped flange 78 slidingly contacting the slot 32. Thus, a portion of the T-shaped flange 78 is contiguous with a portion of the end wall (FIG. 7). This sliding movement also creates an increasing frictional engagement between the T-shaped flange and the end wall 18. Thus, once installed, the force needed to begin sliding the support member 70 downward is relatively large, resisting accidental removal. As shown in FIG. 6B, as the T-shaped flange 78 is being secured, the tab 84 of the finger 80 will engage the end wall tab 34 thereby further securing the support member 70 to the end wall 18. Once secured, the tip 82 of the finger 80 will project through the aperture 22 in the base section 12 of the first elongated member 10. To remove the support member 70, a force F is applied to the tip 82 which releases the tab 84 from the end wall tab 34 thereby allowing the T-shaped flange to be slid downward from the slot 32.

A second preferred embodiment of the present invention is shown in FIGS. 9-13. Since most of the function is substantially identical, reference numerals with a single primed suffix (') refer to like components (e.g., the display member is referred to by reference numeral 100'), and new numerals identify new components.

Figure 9:
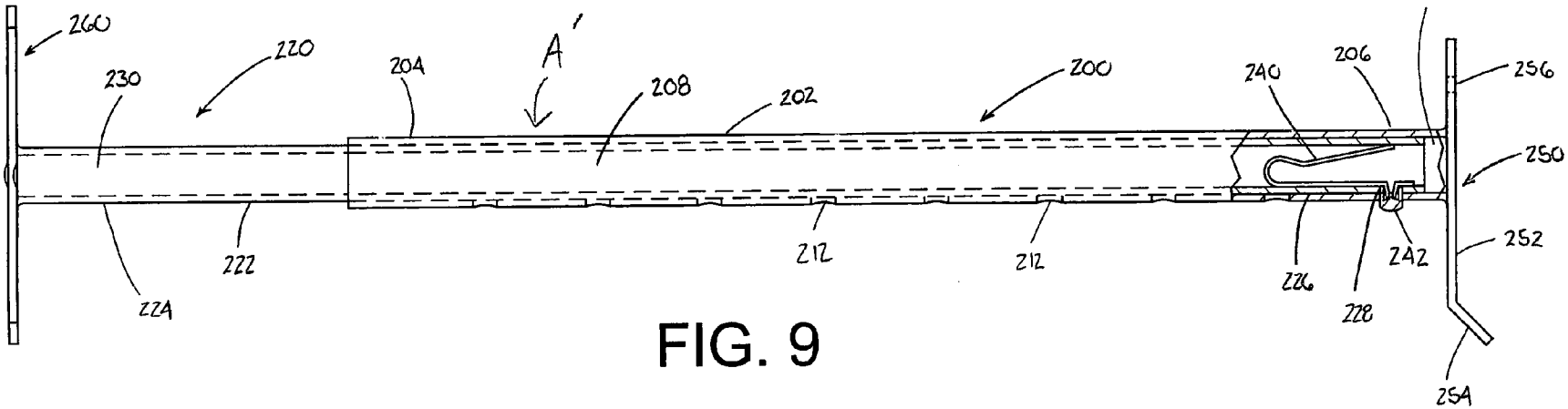
FIG. 9 is a side elevational view, partially broken away, of a telescopic sign holder according to a second preferred embodiment of the present invention.
Figure 13:
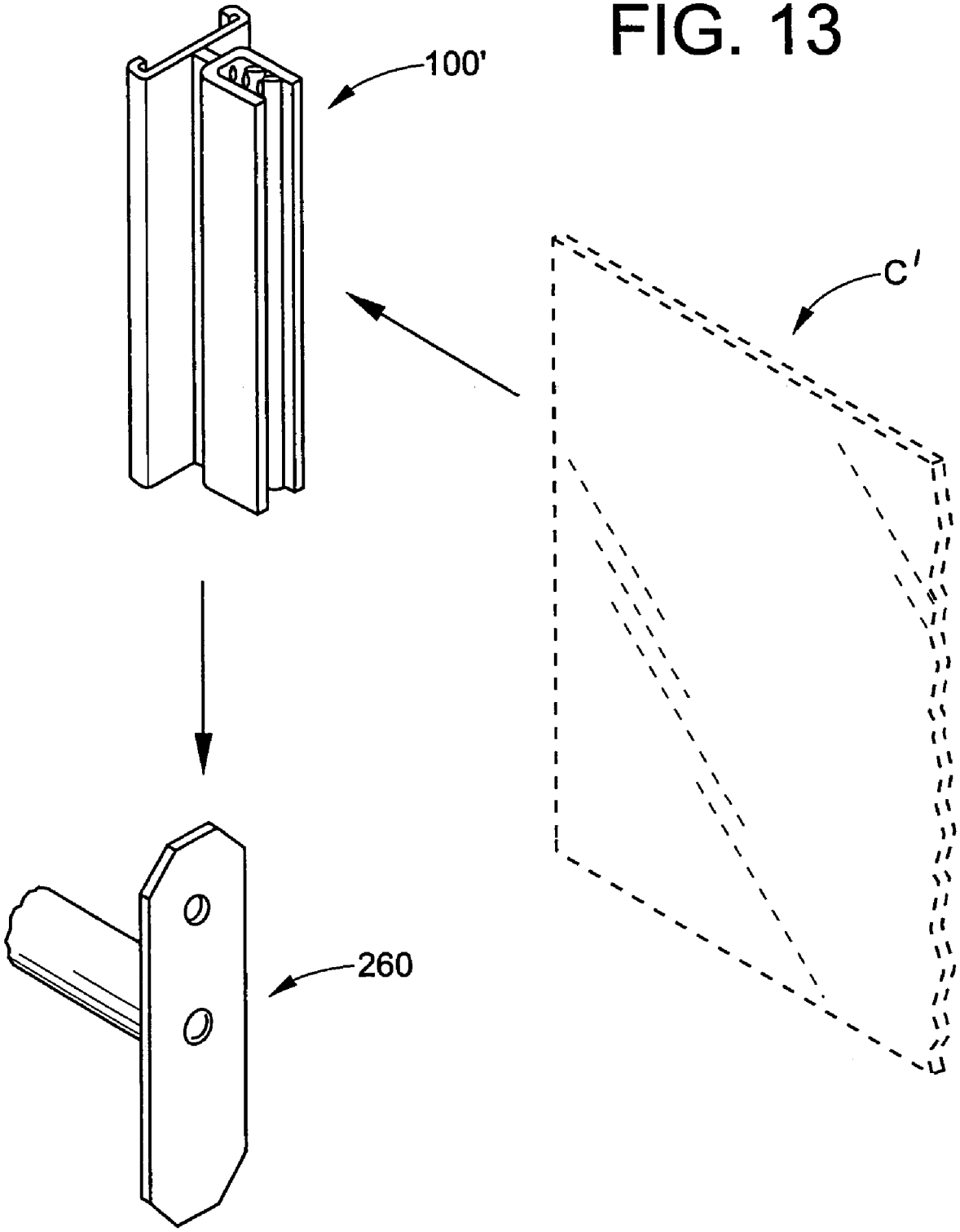
FIG. 13 is an exploded perspective view of the front end and the display member of the telescopic sign holder of FIG. 9 to show how they cooperate to hold a sign.

With reference to FIGS. 9 and 13, a telescopic sign holder A' includes a first elongated member 200, a second elongated member 220 projecting from the first elongated member and a display member 100' attached to an end portion of the second elongated member for releasably securing an associated sign C'. In this embodiment, the first and second elongated members can be generally circular in cross-section.

Figure 10:
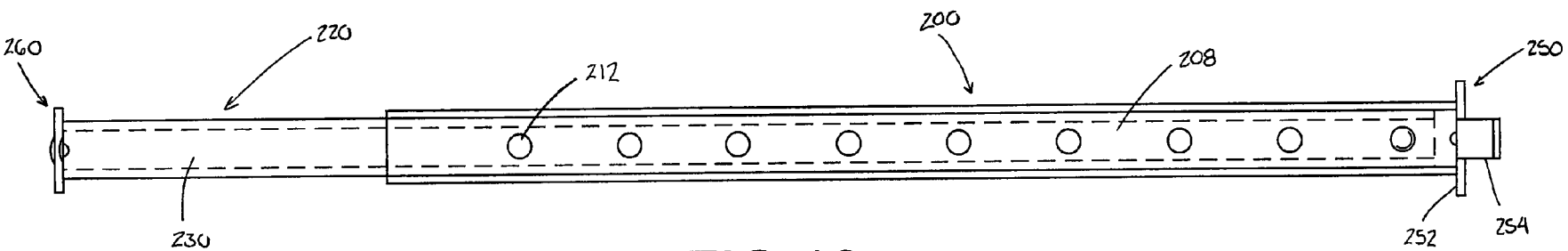
FIG. 10 is a bottom plan view of the telescopic sign holder of FIG. 9.

The first elongated member 200 includes a sleeve 202 having a front end 204 and a rear end 206, as well as an exterior periphery 208. Extending longitudinally from the front end 204 towards the rear end 206 in the sleeve 202 is a socket 210. Longitudinally spaced along the exterior periphery 208 is a plurality of openings 212. As shown in FIG. 10, in this embodiment, the first elongated member 200 includes nine spaced apart openings. However, it can be appreciated by one skilled in the art that more or less than nine openings may be employed depending on the intended use of the sign holder A'.

Adapted to cooperate with the first elongated member 200 is the second elongated member 220. The second elongated member can comprise a longitudinally extending hollow shaft 222 which is so sized as to fit in the socket 210 of the sleeve 202. The shaft includes a first end 224 and a second end 226. A single aperture 228 is formed along an exterior periphery 230 of the second end 226 and is selectively and slidably aligned with one of the plurality of openings 212 formed along the exterior periphery 208 of the first elongated member 200.

With continued reference to FIG. 9, an outwardly biasing spring-loaded clip portion 240 is inserted within the second end 226 of the second elongated member 220 so that an outwardly biasing button portion 242 selectively projects through the single aperture 228 and one of the plurality of openings 212 of the overlapping first elongated member 200. The overall length of the sign holder A' may be adjusted simply by pressing the button portion 242 inwardly and then axially sliding the first and second elongated members 200, 220 relative to one another until a desired opening 212 of the plurality of openings aligns over the single aperture 228, at which point the button portion will again project downwardly through the aperture 228 and one of the plurality of openings 212 snapping the first and second elongated members in place.

In this embodiment, a support member 250 in the shape of a generally planar section 252 is connected, such as by welding, to the rear end 206 of the first elongated member 200 for mounting the sign holder A' to a support surface (not shown). The support member includes a finger or tab 254 extending away from the planar section 252 and a hole 256 extending through the planar section for receiving conventional mounting hardware (not shown). The tab 254 is received within an aperture in the support surface C' in a similar fashion to the pair of projecting fingers 86 described in the first preferred embodiment.

Figure 11:
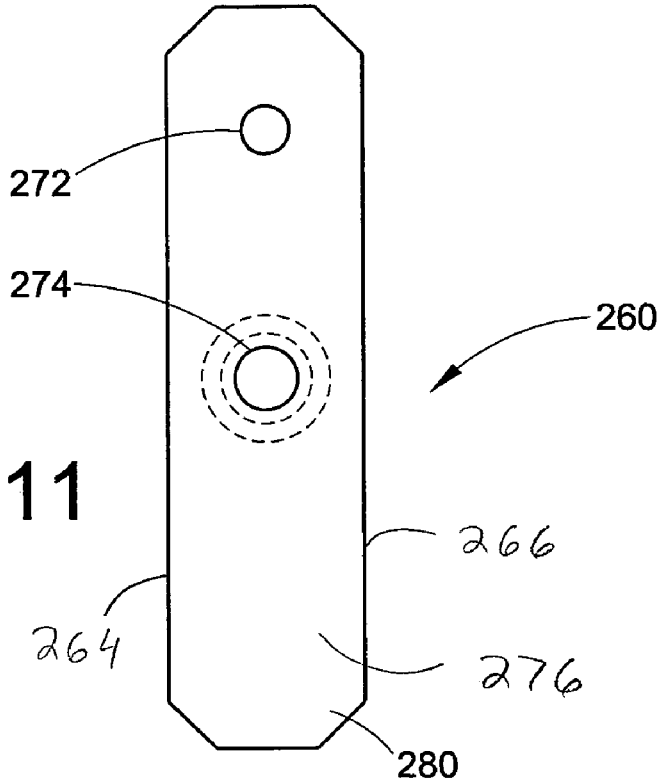
FIG. 11 is an enlarged front elevational view of the telescopic sign holder of FIG. 9.

With reference to FIG. 11, secured, such as by welding, to the first end 224 of the second elongated member 220 is a plate 260. The plate comprises a generally rectangular, planar support body 262 having opposed vertical edges 264, 266. An aperture 272 can extend through the plate 260, if desired, for holding connecting hardware, not shown. A protrusion 274 extends forwardly of a front, planar surface 276 of the support body 262. The protrusion can be generally hemispherical in shape, although other shapes are also contemplated. A shelf (not shown) can extend forwardly of a lower end 280 of the support body 262 for preventing the display member 100' from sliding off the lower end of the plate 260.

With reference now to FIG. 12B, the display member 100' includes features similar to the display member 100 of the first preferred embodiment. As it relates to the U-shaped channel 110', the longest dimension of the U-shaped channel is generally parallel to and generally coextensive with the longest dimension of the hinge portion 108' (i.e., with hinge and channel longest dimensions are both vertically oriented). Thus, the hinge flexes readily in directions S and T when a force is applied to one or other of the faces of the sign.

The display member 100' further includes a proximal or engagement portion 290 which is shaped to releasably and frictionally engage the support body 262 of the plate 260. Specifically, the engagement portion includes a generally planar forward wall 292 with two opposed rearwardly extending U-shaped flanges 294, 296, which each define a channel to receive the sides 264, 266, respectively, of the support body 262 therein.

With reference to FIG. 13, to assemble the display member 100' and the plate 260, the display member is positioned above the plate, and slid downward over the plate, the U-shaped flanges 294, 296 slidingly contacting the vertical edges 264, 266 of the support body 262. The edges can have tapered, lower ends adjacent the lower end 280 of the support body, so that the edges 264, 266 increase in width towards the bottom, creating an increasing frictional engagement between the U-shaped flanges and the support body. The momentum developed in sliding the display member 100' downwards onto the plate 260 allows the user to overcome this friction force and complete the installation of the display member. However, once installed, the force needed to begin sliding the display member upwards is relatively large, resisting accidental removal. Additionally, the protrusion 272 provides an outward force on the forward wall 292, such that by the time the display member has reached a lower end of the support body, the display member is gripping the support body sufficiently firmly to resist displacement of the display portion if knocked from below.

While in the second embodiment of the invention illustrated in FIGS. 9-13 the display member 100' is shown as being oriented normal to the longitudinal axes of the first and second elongated members 200, 220 it should be appreciated that the display member could extend along or approximately parallel to the longitudinal axes of the elongated members, as in the first embodiment of FIGS. 1-8. Also, the support member 250 could be made detachable from the first elongated member 200, as in the embodiment of FIGS. 1-8.

In the first embodiment of the present invention, the first elongated member 10, the second elongated member 40, and the support member 70, can all be made of a suitable conventional thermoplastic material, such as a relatively rigid plastic, so that the members are formed in a single molding operation. Of course, it should be recognized that one or more of these components could also be made from any other conventional type of material, such as metallic and composite materials. In the second embodiment of the present invention, the first elongated member 200, the second elongated member 220, the support member 250 and the plate 260 can all be made of a suitable metallic material.

The display member 100, 100' may be integrally formed from suitable thermoplastic materials by coextrusion or by other known manufacturing methods. A clear flexibly resilient material is particularly preferred. More preferably, the hinge 108, 108' and the fins 120, 120' can be made from a resiliently flexible material, such as a urethane (e.g., Pellethane™, obtained from Dow Plastics), while the remaining portions of the display member can be formed from a less flexible, relatively rigid material, such as a polyvinyl chloride (PVC).

The exemplary embodiments of the invention have been described with reference to the preferred embodiments. Obviously, modifications and alterations will occur to others upon reading and understanding the preceding detailed description. It is intended that the embodiments of the invention be construed as including all such modifications and alterations insofar as they come within the scope of the appended claims or the equivalents thereof.

What is claimed is:

1. A telescopic sign holder for mounting to an associated support surface, said telescopic sign holder comprising:

a first elongated member;

a second elongated member slidably mounted in relation to said first elongated member, said second elongated member including a longitudinal axis;

an adjusting structure for axially spacing said second elongated member relative to said first elongated member, said adjusting structure comprising a portion of at least one of said first and second elongated members;

a support member attached to said first elongated member, said support member including a mounting element for releasably securing said support member to the associated support surface; and, a display member connected to said second elongated member and including a sign holding portion for releasably holding an associated sign in a depending manner, wherein said display member includes a longitudinal axis defined along a face of said display member and extending parallel to said longitudinal axis of said second elongated member, wherein said display member is positioned within at least a portion of said second elongated member, wherein said adjusting structure includes a plurality of spaced apart apertures disposed along a portion of one of said first and second elongated members, and a protrusion supported by another of said first and second elongated members, said protrusion being selectively engaged with one of said plurality of apertures to secure said second elongated member in relation to said first elongated member at a desired location.

2. The telescopic sign holder of claim 1 wherein said first elongated member includes a base section and a pair of generally parallel arm sections extending downwardly therefrom, said base section and said arm sections defining a first generally U-shaped channel for receiving said second elongated member.

3. The telescopic sign holder of claim 2 wherein said first elongated member further comprises an end wall which includes an elongated slot for receiving a portion of said support member and a tab for selectively securing said support member in place.

4. The telescopic sign holder of claim 2 wherein said base section includes at least one reinforcing member for providing additional stability against deflecting forces.

5. The telescopic sign holder of claim 2 wherein each arm section of said first elongated member includes at least one inwardly extending tab for holding a cooperating portion of said second elongated member within said first generally U-shaped channel.

6. The telescopic sign holder of claim 1 wherein said second elongated member includes a base section and a pair of generally parallel arm sections extending therefrom, said base section and said arm sections defining a second generally U-shaped channel for receiving said display member.

7. The telescopic sign holder of claim 6 wherein an inner surface of said second elongated member base section includes a pair of spaced apart walls for preventing an axial movement of said display member within said second generally U-shaped channel.

8. The telescopic sign holder of claim 6 wherein at least one of said arm sections includes a flange for securing said display member within said second generally U-shaped channel.

9. The telescopic sign holder of claim 1 wherein said plurality of apertures are disposed along a portion of said first elongated member, a resilient tab extending downwardly from said second elongated member, said protrusion being outwardly disposed on said tab.

10. The telescopic sign holder of claim 1 wherein said support member includes a generally planar section and said support member further comprises a resilient finger which projects from said planar section, said resilient finger engaging an aperture in said first elongated member.

11. The telescopic sign holder of claim 1 wherein said mounting element comprises at least one finger extending from said support member for engaging at least one aperture of the associated support surface.

12. The telescopic sign holder of claim 1 wherein said display member includes an engagement portion, a hinge portion and a sign holding portion connected with said hinge portion for selectively holding an associated sign.

13. The telescopic sign holder of claim 1 wherein said first elongated member includes a longitudinal axis, wherein as said second elongated member slides in said first elongated member, said longitudinal axis of said second elongated member is generally coaxial with said longitudinal axis of said first elongated member.

14. The telescopic sign holder of claim 1 wherein said display member comprises at least one resilient fin which engages the associated sign, said at least one resilient fin extending coaxial with said longitudinal axis of said second elongated member.

15. The telescopic sign holder of claim 1 wherein said display member depends from said second elongated member.

16. The telescopic sign holder of claim 1 wherein said display member includes a hinge portion.

17. A telescopic sign holder mounted to an associated generally vertically oriented support surface, said telescopic sign holder comprising:

a first elongated member including a base section and a pair of generally parallel arm sections extending therefrom, said base section and said arm sections defining a first generally U-shaped channel;

a second elongated member slidably secured to said first elongated member, said second elongated member including a base section and a pair of generally parallel arm sections extending therefrom, said base section and said arm sections defining a second generally U-shaped channel;

a support member attached to said first elongated member, said support member including a generally planar section and at least one engaging finger extending from said planar section for securing said support member to the associated support surface; and, a display member secured to said second generally U-shaped channel for selectively holding an associated sign, wherein said second elongated member is telescopically received in said first generally u-shaped channel, wherein the arm sections of said first elongated member include a plurality of spaced adjustment notches located therein and wherein each arm section of said second elongated member includes a resilient protrusion, said protrusion being selectively engaged with one of said plurality of adjustment notches to secure said second elongated member in relation to said first elongated member at a desired location.

18. The telescopic sign holder of claim 17 wherein each arm section of said second elongated member includes a downwardly extending resilient tab, said protrusion being disposed on said tab.

19. The telescopic sign holder of claim 17 wherein at least one of said arm sections of said first elongated member includes at least one inwardly extending tab for holding a cooperating portion of said second elongated member within said first generally U-shaped channel.

20. The telescopic sign holder of claim 17 wherein at least one of said arm sections of said second elongated member includes a flange for securing said display member within said second generally U-shaped channel.

21. A telescopic sign holder mounted to an associated approximately vertically oriented support surface, said telescopic sign holder comprising:

a first elongated member;

a second elongated member telescopically received by said first elongated member, a portion of said second elongated member projecting from said first elongated member;

a support member attached to said first elongated member, said support member including a planar portion and a finger protruding therefrom, the finger engaging an aperture in the associated support surface; and, a display member secured to said second elongated member for selectively holding an associated sign, said display member including an engagement portion for engaging said second elongated member, a hinge portion connected to said engagement portion and a sign holding portion connected to said hinge portion for selectively holding an associated sign in a pivotable manner, wherein said first and second elongated members have a generally U-shaped cross-section.

22. The telescopic sign holder of claim 21 wherein said first elongated member includes a hollow interior which accommodates at least a portion of said second elongated member.

23. The telescopic sign holder of claim 21 further comprising a locking structure for selectively locking said second elongated member in a desired position in relation to said first elongated member.

24. The telescopic sign holder of claim 21 wherein said display member is mounted in said second elongated member.

25. The telescopic sign holder of claim 21 wherein said display member includes a longitudinal axis extending parallel to a longitudinal axis of said second elongated member.

* * * * *